United States Patent [19]

Jones

[11] 4,304,184

[45] Dec. 8, 1981

[54] SELECTIVELY ACTUABLE ELECTRICAL CIRCUIT

[75] Inventor: Eirwyn Jones, Alloway, Scotland

[73] Assignee: Imperial Chemical Industries Limited, Millbank, England

[21] Appl. No.: 109,109

[22] Filed: Jan. 2, 1980

[30] Foreign Application Priority Data

Jan. 15, 1979 [GB] United Kingdom ..... 01349/79

[51] Int. Cl.[3] ..... F42C 11/00

[52] U.S. Cl. ..... 102/202.13; 102/202.2; 361/248

[58] Field of Search ..... 102/28 R, 28 P, 5 A, 102/5 M, 5 E, 5 R, 5 WB, 203; 361/248

[56] References Cited

U.S. PATENT DOCUMENTS

| | | | |
|---|---|---|---|
| 3,185,093 | 5/1965 | Holinbeck | 102/28 R |
| 3,425,004 | 1/1969 | Warner | 333/79 |
| 3,425,004 | 1/1969 | Warner | 333/184 |
| 3,762,331 | 10/1973 | Vlahos | 102/28 R |

FOREIGN PATENT DOCUMENTS

| | | | |
|---|---|---|---|
| 2153059 | 5/1973 | Fed. Rep. of Germany . | |
| 341903 | 1/1931 | United Kingdom | 102/28 R |
| 563345 | 8/1944 | United Kingdom | 102/28 R |
| 1186758 | 4/1970 | United Kingdom . | |
| 1235844 | 6/1971 | United Kingdom | 102/28 R |
| 1366609 | 9/1974 | United Kingdom | 102/28 R |
| 1368223 | 9/1974 | United Kingdom . | |
| 1423303 | 2/1976 | United Kingdom . | |
| 2014380 | 8/1979 | United Kingdom . | |

*Primary Examiner*—Donald P. Walsh
*Attorney, Agent, or Firm*—Larry S. Nixon

[57] ABSTRACT

A control circuit for firing an electrically actuable igniter in response to a firing signal having predetermined characteristics. For protection from inadvertent or accidental actuation, the control circuit includes at least one inductor in series with the fuse wire of the igniter and at least one inductor in parallel with the source of the firing signal. The series and parallel inductors are electromagnetically coupled to one another through a ferrite bead and are electrically connected so as to generate opposed magnetic effects when current flows through them. Electric detonators incorporating the control circuit are also detailed.

42 Claims, 7 Drawing Figures

Fig. 1.
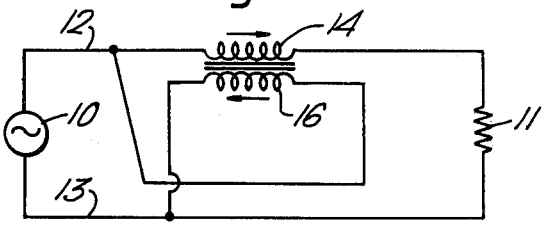
Fig. 2.
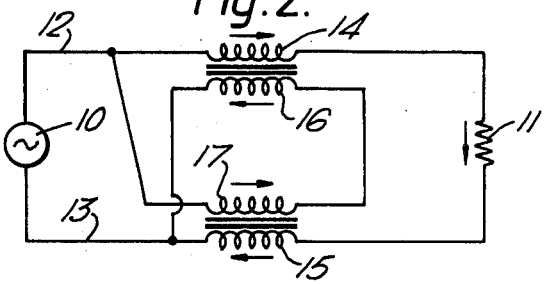
Fig. 3.
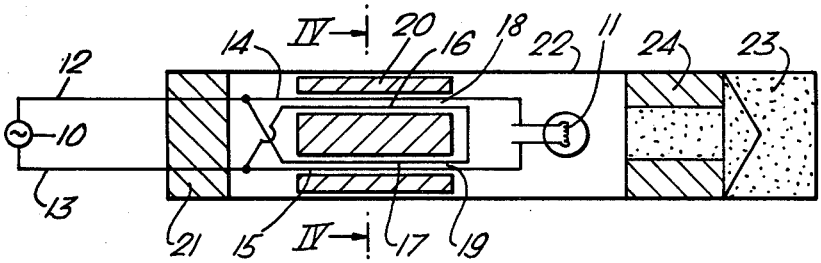
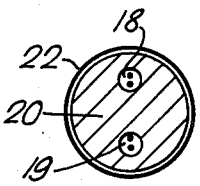
Fig. 4.

Fig. 5.
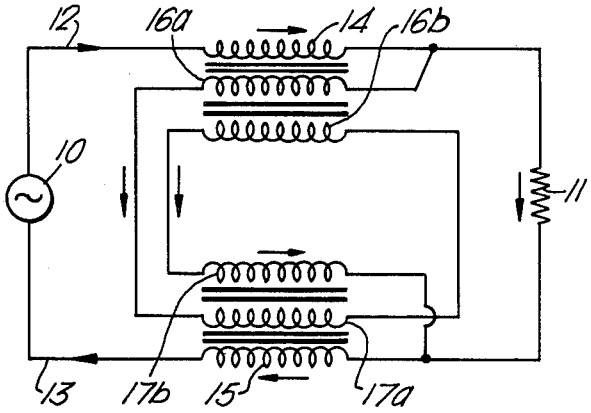
Fig. 6.
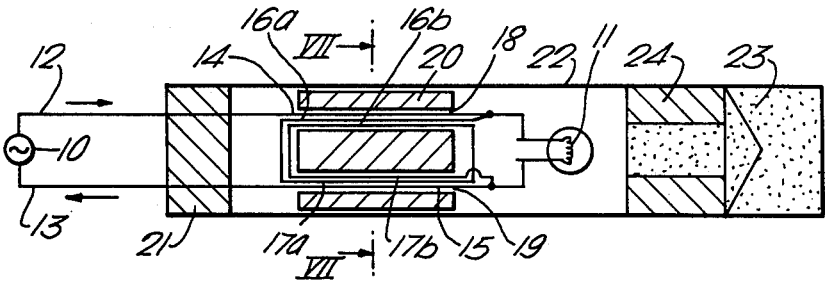
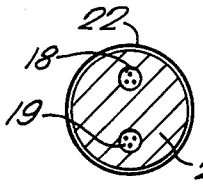
Fig. 7.

SELECTIVELY ACTUABLE ELECTRICAL CIRCUIT

BACKGROUND OF THE INVENTION

This invention relates generally to control circuits for the selective actuation or firing of electrical loads such as ignitors used as electric fuseheads in blasting detonators and for the igniting of incendiary charges in pyrotechnic devices, etc. More specifically, this invention relates to electrical control circuits for energizing an electrically ignitable load while providing protection from inadvertent or accidental ignition.

Fusehead assemblies are used in many contexts such as blasting operations, seismic exploration, and for the actuation of passive restraint systems in automobiles. Each such fusehead assembly includes at least one electrical ignition device, such as a fusehead, disposed in ignition relationship with one or more explosive charges. In all of these applications, it is important for the electrically ignitable load to be promptly actuated when desired, while at the same time for the load to be protected from inadvertent or accidental ignition.

In blasting operations and in seismic exploration, explosive charges are usually detonated from a remote firing point to ensure operator safety. An electrical firing signal is transmitted to a detonator which instantaneously or after some predetermined time delay explodes and ignites a main explosive charge.

Usually, an electric fusehead is ignited by an electrical current passing through a fuse wire (bridge wire) or metallic film constituting a resistive load. When sufficient electrical current passes through the fuse wire or metallic film, joule heating takes place and the temperature of the wire or film rises sufficiently to ignite a chemical composition disposed in contact or in close proximity with the wire or film. The heat generated from the ignition of the chemical composition is then utilized to ignite a sequence of pyrotechnic and/or explosive charges which in turn ignite or detonate the main explosive charge. The electrical energy for igniting the fusehead is usually obtained from a battery, pulse generator, AC power supply or the discharge of a capacitor.

To ensure operator safety during the storage and installation of explosive charges utilizing electrical fusehead detonators, it is essential that ignition of the fusehead does not occur until an authentic firing signal is generated. However, the environment within which electric fuseheads are stored, transported, installed, and operated usually includes various sources of electrical energy that are capable of inducing an accidental or inadvertent ignition of the fusehead. For example, typically during blasting operations involving large numbers of personnel, batteries, and electric fuseheads, there may be accidental or unauthorized direct connection of the lead wires of a fusehead to a battery or other power source. In addition, power wiring located in the vicinity of a blasting site may electromagnetically induce sufficient current to ignite an electric fusehead. Furthermore, currents may be induced in the lead wires of a fusehead from electromagnetic radiation from communication transmitters, radar installations, and the like. Another potential source of induced firing current is static electric discharge from the loading of a dry granular explosive. For automobile passive restraint systems, the electric battery in the automobile constitutes a source of electrical energy for accidental connection during maintenance or testing of the automobile.

The degree of safety associated with a given electric fusehead installation depends upon both the sensitivity of the fusehead to ignition by spurious sources of electrical energy and upon the probability that such spurious sources will be encountered. Various approaches to the problem of enhancing the degree of safety associated with the operation of electric fuseheads have been taken. One such approach has been to decrease the sensitivity of an electric fusehead by designing the fusehead so as to require very high firing currents for igniting the pyrotechnic chemical disposed adjacent to the fuse wire or film which is heated by the firing signal. This approach requires the use of heavy and expensive wiring and requires the use of power sources providing high energy levels. In addition to the increased expense associated with this approach, this approach fails to provide adequate safety for some operations, such as in mining where dry granular explosives are loaded by compressed air.

One approach to the safe handling of fusehead igniters is set forth in a prior copending application of Jones, et al for an Electric Igniter filed May 15, 1979 and bearing Ser. No. 39,443. That application teaches a system for actuating a plurality of electrically actuable igniters by utilizing a continuous length of insulated wire looped around a transformer core having a movable portion. The movable portion is utilized to assemble a firing configuration using a multiple igniter looped therethrough.

Another approach is shown in a co-pending application of Andrew Stratton bearing Ser. No. 4,265 filed Jan. 17, 1979. This invention relates to linking an ignitable load such as a fusehead to a source of power by coupling through a transformer constructed to provide a substantial leakage inductance associated with the secondary winding. In this manner input electrical energy having only a predetermined magnitude in frequency characteristic will actuate the load.

A further approach in the safe handling and actuation of electric fuseheads has been to incorporate tuned circuits for selectively energizing an electric fusehead in response to an input electrical signal having a predetermined frequency. For example, U.S. Pat. No. 3,762,331 teaches the use of a voltage step-down transformer in combination with capacitors and an inductor for selectively operating an electric fusehead at a frequency of approximately 10 KHz. The voltage ratio of the step-down transformer is large (on the order of 100:1) so as to increase the voltage level required for firing thereby decreasing the sensitivity of the fusehead to spurious input voltages even if the input voltage is within the correct frequency range. A series input capacitor is utilized to block accidental ignition from spurious DC voltages and to attenuate low frequency AC signals (50–60 Hz. power frequencies). A shunt capacitor is coupled across the primary of the transformer to bypass higher frequency radio signals which may appear across that winding. A series input inductor is utilized to match input line impedances and to attenuate higher frequencies. Coupling transformers for use in such protective systems have been designed so that magnetic saturation of the transformer core provides increased protection against improper fusehead ignition at AC power frequencies (50–60 Hz.).

The use of a transformer coupled electric fusehead is illustrated in British Pat. No. 1,235,844, published in 1971. This British patent shows a pot-shaped core transformer coupled AC input for an electric fusehead which ignites in response to a firing signal having a frequency of 330 Hz. Protection from higher frequencies is achieved through transformer core loss attenuation.

Although the use of transformers having large step-down ratios are reasonably effective in protecting electric fuseheads, their usefulness is limited because they are impractical. Typically, fusehead firing voltages on the order of 100 volts are required. Such voltages are not always available or not commercially realistic. Furthermore, for use in complex blasting operations the use of large individual detonator firing signal voltages may require excessive large overall firing voltage for a series connection of a plurality of the circuits. Furthermore, transformers having large step-down ratios are often bulky and therefore difficult to handle. In addition, such transformers provide little protection against high energy static discharges typically encountered in blasting operations. Thus, these transformer circuits remain vulnerable to accidental ignition during transport, storage and connection into a blasting arrangement including multiple devices. Thus, there is still a need for a more simplified and commercially feasible control circuit for electric fuseheads providing protection from accidental or inadvertent ignition during manufacture, transport, storage and connection into a blasting arrangement.

SUMMARY OF THE INVENTION

This invention provides a selectively actuable control circuit especially useful for firing electrically actuable igniters of the type used in electric fuseheads and the like. It utilizes series and shunt inductors to provide a high degree of protection from inadvertent or accidental firing of its associated igniter during manufacture, transport, storage, and incorporation into a blasting arrangement.

The control circuit according to the present invention includes at least one inductor, coupled as a shunt in parallel with the load. This shunt inductor provides a degree of protection from DC and power line frequency AC (50–60 Hz.). For protection against static electricity discharge and radio frequency induced currents and for reduction of the required operating voltage and current for a selected activation frequency, the control circuit includes at least one series inductor coupled between the source and load.

The series and shunt inductors are electromagnetically coupled to one another by a ferro-magnetic circuit. Furthermore, the shunt and series inductors are electrically connected to form the primary and secondary windings of a step-up auto-transformer and are oriented so as to generate opposing magnetic effects when current flows through the inductors from the source of firing energy to the fuse wire.

The control circuit provided is easily incorporated into an electric fusehead within an explosive detonator casing and is economical to produce.

Complete electric fuseheads incorporating various exemplary embodiments of the control circuit are set forth below including an explosive charge detonated in response to the ignition of the fusehead. A complete fusehead detonator may include a metal casing; a control circuit having at least one series and one shunt inductor, the inductors being electrically connected to form a step-up auto-transformer; a ferrite bead forming a ferromagnetic circuit for electromagnetically coupling the series and shunt inductors, the ferrite bead having at least one passage through which the series and shunt inductors are threaded; a resistive fusehead load; an explosive charge train; and a delay element. Lead wires coupled to the series and shunt inductors may pass through a sealing plug for connection to a source of firing energy.

BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

FIG. 1 is a schematic diagram of a first exemplary embodiment including the actuable control circuit according to the current invention;

FIG. 2 is a schematic diagram of a second exemplary embodiment including the actuable control circuit according to the present invention;

FIG. 3 is a diagrammatic longitudinal medial section of an electric fusehead detonator incorporating the actuable control circuit shown in FIG. 2;

FIG. 4 is a cross-sectional view of the fusehead detonator shown in FIG. 3 taken on line IV—IV of FIG. 3;

FIG. 5 is a schematic diagram of a third exemplary embodiment including the actuable control circuit according to the present invention;

FIG. 6 is a diagrammatic longitudinal medial section of an electric fusehead detonator incorporating the actuable control circuit shown in FIG. 5; and FIG. 7 is a cross-sectional view of the fusehead detonator shown in FIG. 6 taken on line VII—VII of FIG. 6.

DETAILED DESCRIPTION OF THE PREFERRED EMBODIMENTS

Referring now to the figures wherein like reference numerals designate like or corresponding parts throughout the several views, and specifically referring to FIG. 1, there is shown a schematic diagram of a first embodiment of the control circuit according to the present invention. An energy source 10 is coupled to a fusehead resistive load 11 such as a fuse wire or metallic film through a pair of lead wires 12 and 13. An inductor 16 is shunt coupled across lead wires 12 and 13 and a second inductor 14 is series coupled between lead wire 12 and one end of load 11. Inductors 14 and 16 are wired to form a 2:1 voltage step-up auto-transformer with shunt inductor 16 as its primary and series inductor 14 at its secondary. Inductors 16 and 14 are electromagnetically coupled to one another within a ferromagnetic circuit and are connected so as to generate opposing magnetic effects when current flows through the inductors from the source of firing energy to load 11. Arrows in the figure indicate relative current flow directions within inductors 14 and 16.

Inductor 16 coupled in shunt across energy source 10 provides a low impedance shunt path for extraneous electrical energy from DC and 50–60 Hz. AC. Series inductor 14 provides protection against static electricity and RF hazards and helps to reduce the operating voltage and current required for a selected activation frequency. Shunt and series inductors 16 and 14 are selected to provide a desired degree of protection in accordance with the firing characteristics of a particular fusehead. These firing characteristics include but are not limited to the type and resistance of bridgewire or metallic film utilized as resistive load 11, the firing energy threshold intende for firing the fusehead, the lag time between the application of energy from source 10 to detonation, and the frequency of electrical energy applied for causing detonation. In practice, the optimum range of operating frequencies for electric fuseheads is 3–20 KHz. Therefore, the series and shunt inductors are selected to control the magnitude of current flowing through the secondary inductor relative to the frequency of the current flowing in the primary inductor. The appropriate selection of inductor values therefore tends to limit the energy transfer to the load to a safe value at frequencies above and below a predetermined operating frequency range.

The values of the shunt primary and series secondary inductors are chosen such that at frequencies below the desired operating frequency range, the primary inductor provides a virtual short circuit shunt across the fusehead input. Thus, at 50–60 Hz. power frequency, for example, the value of the shunt primary inductor can be chosen such that the fusehead will not fire with the application of currents as high as 10 amps and yet will fire with a much lower current at a much higher desired operating frequency.

Further, the values of shunt and series inductors 16 and 14 are selected with due consideration to the type of input signals against which protection is desired. In general a detonator should at least be protected from inadvertent or accidental connection to an electric batteries (DC); from currents induced by 50–60 Hz. power supplies and power lines; from radio frequencies in excess of about 100 KHz; and from capacitive discharges.

The shunt primary and series secondary inductor are coupled to form a step-up autotransformer and have values selected so that no more than twice the customary operating current is required to fire the fusehead. This allows the use of readily available power sources.

Additional protection can be provided by the inclusion of a fusehead link in series with the shunt primary inductor. Similarly, for high frequency protection the inductor characteristics are selected to insure that high frequency spurious signals above a predetermined frequency and capacitive spark discharges will not induce currents having a magnitude greater than a predetermined safe level. This is achieved by energy loses in the ferromagnetic circuit (core losses) and the harmless shunting of up to 50 percent of the current through the primary inductor.

Referring now to FIG. 2, there is shown a schematic diagram of a second embodiment of the control circuit according to the present invention. This second embodiment includes a second inductor 17 coupled in series with inductor 16, the series circuit of inductors 16 and 17 being in shunt across power source 10. As in the embodiment shown in FIG. 1, there is a series inductor 14 coupled from lead wire 12 to one end of resistive load 11. An additional series inductor 15 is coupled from lead wire 13 to the other end of resistive load 11. Shunt inductor 16 is electromagnetically coupled with series inductor 14 and shunt inductor 17 is electromagnetically coupled with series inductor 15. Shunt inductors 16 and 17 and series inductors 14 and 15 form a 2:1 step-up autotransformer as did shunt inductor 16 and series inductor 14 in the embodiment shown in FIG. 1.

Referring now to FIG. 3, there is shown a diagrammatic longitudinal medial section of an electric detonator incorporating the control circuit shown in FIG. 2. Series inductors 14 and 15 are straight portions of the detonator lead wires 12 and 13. These straight portions of wire are threaded respectively through two passages 18 and 19 extending longitudinally through a cylindrically shaped ferrite bead 20. Shunt inductors 16 and 17 are straight portions of insulated wire, suitably having a finer gauge than that of detonator lead wires 12 and 13. The insulated wire forming shunt inductors 16 and 17 is also threaded through passages 18 and 19 respectively, and coupled to detonator lead wires 12 and 13. Series inductors 14 and 15 are coupled to fusehead resistive load 11. The entire ferrite bead and fusehead resistive load 11 are contained within a metal casing 22, also containing an explosive charge train 23 and a delay element 24. Metal casing 22 is sealed by a sealing plug 21 through which detonator lead wires 12 and 13 pass for connection to electrical power source 10.

To fire the detonator, detonator lead wires 12 and 13 are coupled to electrical power source 10 having the appropriate frequency characteristics for firing the fusehead. The frequency will be dependent upon the values of the inductors selected for shunt inductors 16 and 17 and series inductors 14 and 15. The value of all four inductors depends not only upon the length and gauge of wire utilized but also on the dimensions of ferrite bead 20 and upon the permeability of the ferrite utilized in the bead. The smaller the longitudinal cross-sectional area of the bead and the lower its permeability, the higher the frequency required for a given level of protection. The same effect is achieved by lowering the DC resistance of the shunt inductors 16 and 17.

Referring now to FIG. 4, there is shown a cross-section of the electric detonator shown in FIG. 3. The two passages 18 and 19 within ferrite bead 20 are clearly shown with two wires threaded through each, one of these being a primary inductor and the other a secondary inductor.

Referring now to FIG. 5, there is shown a schematic diagram of a third embodiment of the control circuit according to the present invention. In this third embodiment, there are two series inductors 14 and 15, one each coupled from lead wires 12 and 13 to opposite ends of resistive load 11. Associated with secondary inductor 14 are two shunt inductors **16*a* and 16*b* electromagnetically coupled with one another and with series inductor 14. Associated with series inductor 15 are two shunt inductors 17*a* and 17*b* electromagnetically coupled with one another and with secondary inductor 15. The four shunt inductors are coupled in series with one another across the resistive load 11 such that current would pass through shunt inductor 16*a* then through shunt inductor 17*a* then through shunt inductor 16*b* and finally through shunt inductor 17*b*. The relative directions of current flow in all inductors are indicated by the arrows shown in the figure. It should be noted that current flow in series inductor 14 is opposite in direction to the current flow in shunt inductors 16*a* and 16*b*. Similarly, current flow in series inductor 15 is opposite in direction to the current flow through shunt inductors 17*a* and 17*b*. In a similar fashion to the circuits shown in FIGS. 1 and 2, the combination of shunt and series inductors forms a 2:1 step-up auto-transformer with similar electrical characteristics to that shown in FIG. 2**.

Referring now to FIG. 6, there is shown a diagrammatic longitudinal medial section of an electric detonator incorporating the control circuit set forth in FIG. 5. As with the detonator shown in FIG. 3, all inductors are straight portions of wire. Secondary inductor 14 and shunt inductors 16*a* and 16*b* are all threaded through a common passage 18 of ferrite bead 20. Series inductor 15 and shunt inductors 17*a* and 17*b* are threaded though the second common passage 19 of ferrite bead 20. Metal case 22 encloses the entire control circuit, delay element 24 and explosive train 23 as in the embodiment shown in FIG. 3.

SPECIFIC EXAMPLE

In the detonators shown in FIGS. 3 and 6, ferrite bead 20 is suitably a high permeability ferrite, 0.7 cm in diameter × 1.0 cm. long, passages 18 and 19 being 1 mm in diameter. Series inductors 14 and 15 are suitably portions of 0.61 mm copper wire. Shunt inductors 16, 16*a*, 16*b*, 17, 17*a*, and 17*b* are suitably 0.23 mm diameter enamelled copper wire. Utilizing these particular parameters, the protection afforded against leakage currents whether DC or 50 Hz. AC are in excess of 10 amps even for fuseheads with firing currents as low as 0.1 amps. Protection against 2000 pF, 10 Kv electrostatic discharges were achieved with a type U fusehead (8–16 mJ/Ohm sensitivity, resistance 0.7 to 0.9 Ohms). With a group 2 fusehead (80–140 mJ/Ohm, resistance 0.02 to 0.04 Ohm) the protection was in excess of 25 Kv. 2000 pF.

The firing frequency of the fuseheads used in the above example are 3 to 10 KHz. Within this frequency range, the firing currents are double the normal fusehead firing currents (i.e., 1.1 to 1.3 amps for type U fuseheads).

Therefore, it is apparent that there has been provided a control circuit for energizing an electrically ignited load, such as a fusehead in an explosive detonator, providing increased protection for inadvertent ignition resulting from DC power sources, power lines, static electricity discharges, and radio frequency signals.

The control circuit according to the present invention is configured so as to be substantially inert to a substantial amount of electrical energy induced by sources having frequency characteristics outside of a predetermined range.

Furthermore, the control circuit according to the present invention is selectively actuable in response to an input from an electrical energy source having predetermined magnitude and frequency characteristics.

Other embodiments and modifications of the present invention will be apparent to those of ordinary skill in the art having the benefit of the teachings presented in the foregoing description and drawings. For example, the ferromagnetic circuit can be provided by a ferrite bead. This ferrite bead is suitably manganese-zinc or nickel-zinc ferrite and includes one or more passages formed therein. The primary and secondary inductors are electromagnetically coupled by being threaded through a common passage. It is therefore to be understood that this invention is not to be unduly limited and such modifications are intended to be included within the scope of the appended claims.

What is claimed is:

1. A control circuit for selectively actuating an electrically ignitable load comprising:

first and second input lead wires for coupling to a power source for igniting said load;

first and second output terminals for coupling to said load to be actuated;

at least one first inductor electrically coupled between said first and second input lead wires; and at least one second inductor coupling at least one of said input lead wires with at least one of said output terminals, said first and second inductors being electromagnetically coupled to one another such that magnetic flux produced by current flowing in said first inductor opposes the magnetic flux produced by current flowing in said second inductor.

2. A control circuit according to claim 1 wherein said first and second inductors respectively form the primary and secondary windings of an auto-transformer.

3. A control circuit according to claim 2 wherein said auto-transformer is a 2:1 voltage step-up auto-transformer.

4. A control circuit according to any of claims 1, 2, or 3 wherein said first and second inductors each comprise a length of wire parallel to each other.

5. A control circuit according to any of claims 1, 2 or 3 wherein said first and second inductors are electromagnetically coupled to one another through a ferromagnetic circuit.

6. A control circuit according to claim 5 wherein said ferromagnetic circuit includes a ferrite bead and said first and second inductors are located within a single passage of said ferrite bead.

7. A control circuit for selectively actuating an electrically ignitable load comprising:

first and second input lead wires for coupling to a power source for igniting said load;

first and second output terminals for coupling to said load to be actuated;

at least one first inductor electrically coupled between said output terminals; and at least one second inductor coupling at least one of said input lead wires with at least one of said output terminals, said first and second inductors being electromagnetically coupled to one another such that magnetic flux produced by current flowing in said first inductor opposes the magnetic flux produced by current flowing in said second inductor.

8. A control circuit according to claim 7 wherein said first and second inductors respectively form the primary and secondary windings of an auto-transformer.

9. A control circuit according to claim 8 wherein said auto-transformer is a 2:1 voltage step-up auto-transformer.

10. A control circuit according to any one of claims 7, 8 or 9 wherein said first and second conductors each comprise a length of wire parallel to each other.

11. A control circuit according to any of claims 7, 8 or 9 wherein said first and second inductors are electromagnetically coupled to one another through a ferromagnetic circuit.

12. A control circuit according to claim 11, wherein said ferromagnetic circuit includes a ferrite bead and said first and second inductors are located within a single passage of said ferrite bead.

13. A control circuit for actuating an electrically ignitable load comprising:

first and second input lead wires for coupling to a power source for igniting said loads;

first and second output terminals for coupling to said load to be actuated;

first and second inductors coupled in series with one another and coupling said first and second input lead wires to one another;

a third inductor coupling said first input lead wire with said first output terminal, and being electromagnetically coupled to said first inductor such that the magnetic flux produced by current flowing in the first inductor opposes the magnetic flux produced by current flowing in the third inductor; and a fourth inductor coupling said second input lead wire with said second output terminal, and being electromagnetically coupled to said second inductor.

14. A control circuit according to claim 13 wherein said first and second inductors form the primary winding of an auto-transformer and said third and fourth inductors form the secondary winding of the auto-transformer.

15. A control circuit according to claim 14 wherein said auto-transformer is a 2:1 voltage step-up auto-transformer.

16. A control circuit according to any of claims 13, 14, or 15 wherein each of said inductors comprises a length of wire.

17. A control circuit according to any of claims 13, 14, or 15 wherein said first and third inductors are electromagnetically coupled to one another through a ferromagnetic circuit.

18. A control circuit according to any of claims 13, 14, or 15 wherein said second and fourth inductors are electromagnetically coupled to one another through a ferromagnetic circuit.

19. A control circuit according to claim 17 wherein said ferromagnetic circuit is a ferrite bead and said first and third inductors are located within a single passage of said ferrite bead.

20. A control circuit according to claim 17 wherein said ferromagnetic circuit is a ferrite bead and said second and fourth inductors are located within a single passage of said ferrite bead.

21. A control circuit according to claim 17 wherein said ferromagnetic circuit is a ferrite bead and said first and third inductors are located within a single passage of said ferrite bead and wherein said second and fourth inductors are located within another single passage of said ferrite bead.

22. A control circuit for actuating an electrically ignitable load comprising:

first and second input lead wires for coupling to a power source for igniting said load;

first and second output terminals for coupling to said load to be ignited;

first, second, third and fourth inductors in series with one another and coupling said first and second terminals to one another;

a fifth inductor coupling said first input lead wire with said first output terminal;

a sixth inductor coupling said second input lead wire with said second output terminal;

said first, third, and fifth inductors being electromagnetically coupled to one another and said second, fourth, and sixth inductors being electromagnetically coupled to one another such that the magnetic flux produced by current flowing in the third inductor opposes the magnetic flux produced by current flowing in the fifth inductor and the magnetically flux produced by current flowing in the second inductor opposes the magnetic flux produced by current flowing in the sixth inductor.

23. A control circuit according to claim 22 wherein said first and third inductors form a first primary winding of an auto-transformer; said second and fourth inductors form a second primary winding of the auto-transformer; the fifth inductor forms a first secondary winding of the auto-transformer; and the sixth inductor forms a second secondary winding of the auto-transformer.

24. A control circuit according to claim 23 wherein said auto-transformer is a 2:1 voltage step-up auto-transformer.

25. A control circuit according to any of claims 22, 23, or 24 wherein said inductors comprise a length of wire.

26. A control circuit according to any of claims 22, 23, or 24 wherein said first, third, and fifth inductors are electromagnetically coupled to one another through a ferromagnetic circuit.

27. A control circuit according to claim 26 wherein said ferromagnetic circuit is a ferrite bead and said first, third and fifth inductors are threaded through a common passage of said ferrite bead.

28. A control circuit according to any of claims 22, 23, or 24 wherein said second, fourth, and sixth inductors are electromagnetically coupled to one another through a ferromagnetic circuit.

29. A control circuit according to claim 26 wherein said ferromagnetic circuit is a ferrite bead and said first, third and fifth inductors are threaded through a common passage of said ferrite bead and wherein said second, fourth and sixth inductors are threaded through another common passage of said ferrite bead.

30. A control circuit according to claim 28 wherein said ferromagnetic circuit is a ferrite bead and said second, fourth and sixth inductors are threaded through a common passage of said ferrite bead.

31. A detonator comprising:

a fusehead resistive load;

a ferrite bead having first and second passages therein each passage extending from a first end of said ferrite bead to a second end of said bead;

a pair of lead wires coupled to said resistive load and passing one each through said first and second passages of said ferrite bead from said second to said first end thereof and extending beyond said second end for coupling to a power source;

an inductor wire threaded through said first and second passages such that its two ends extend through said passages at said first end of said ferrite bead, one end of said inductor wire coupled to each of said lead wires so that a portion of said inductor wire shares a passage in common with each of said lead wires, the ends of said inductor wire being cross coupled to said lead wires at said first end of said ferrite bead.

32. A detonator according to claim 31 further including a metal casing surrounding said ferrite bead and resistive load.

33. A detonator according to claim 32 further including a sealing plug for sealing said metal casing, said lead wires extending through said sealing plug.

34. A detonator according to claim 32 further including a delay element and an explosive train.

35. A detonator comprising:

a fusehead resistive load;

a ferrite bead having first and second passages therein each passage extending from a first end of said ferrite bead to a second end of said bead;

a pair of lead wires coupled to said resistive load and passing one each through said first and second passages of said ferrite bead from said first to said second end thereof and extending through said first end for coupling to a power source;

an inductor wire threaded twice through each of said first and second passages such that its two ends extend through said passages at said second end of said ferrite bead, one end of said inductor wire coupled to each of said lead wires so that a portion of said inductor wire shares a passage in common with each of said lead wires, the ends of said inductor wire coupled to said lead wires at said second end of said ferrite bead.

36. A detonator according to claim 35 further including a metal casing surrounding said ferrite bead and resistive load.

37. A detonator according to claim 36 further including a sealing plug for sealing said metal casing, said lead wires extending through said sealing plug.

38. A detonator according to claim 36 further including a delay element and an explosive train.

39. In an electric detonator of the type including a pair of lead wires, a fuse wire and a chemical compound ignitable by the heating of the fuse wire, the improvement comprising:

at least a first inductor electrically in parallel with the lead wires; and at least a second inductor in series with one of the lead wires, the first and second inductors being magnetically coupled in mutual opposition so as to form respectively the primary and secondary windings of a voltage step-up auto-transformer.

40. In an electric detonator of the type including a pair lead wires, a fuse wire and a chemical compound ignitable by the heating of the fuse wire, the improvement comprising:

at least a first inductor electrically in parallel with the fuse wire; and at least a second inductor in series with one of the lead wires, the first and second inductors being magnetically coupled in mutual opposition so as to form respectively the primary and secondary windings of a voltage step-up auto-transformer.

41. A control circuit for selectively actuating an electrically ignitable load comprising first and second input lead wires for coupling the load to a power source for igniting said load and at least one first inductor electrically coupled to said first and second input lead wires so as to be electrically in parallel with the load.

42. A detonator comprising a fusehead resistive load and a control circuit as claimed in claim 1 or claim 41.

* * * * *